United States Patent [19]

Labenski et al.

[11] 4,003,760

[45] Jan. 18, 1977

[54] METHOD OF APPLYING PROTECTIVE COATINGS TO METAL PRODUCTS

[75] Inventors: Wolfgang Labenski, Leimen; Heinz Paul Schapitz, Walldorf; Hans-Peter Wessel, Heidelberg, all of Germany

[73] Assignee: Mecano-Bundy GmbH, Heidelberg, Germany

[22] Filed: Mar. 1, 1974

[21] Appl. No.: 447,105

[30] Foreign Application Priority Data

Mar. 9, 1973 France ..... 73.08593

[52] U.S. Cl. ..... 148/6.2; 427/406; 427/409; 427/372 R; 427/385 R

[51] Int. Cl.[2] ..... C23F 7/26

[58] Field of Search ..... 148/6.2; 117/132 CF; 427/406, 409, 372, 379, 385; 428/421, 422

[56] References Cited

UNITED STATES PATENTS

| | | | |
|---|---|---|---|
| 2,393,663 | 1/1946 | Thomas et al. | 148/6.2 |
| 2,562,117 | 7/1951 | Osdal | 148/6.2 |
| 3,053,691 | 9/1962 | Hartman et al. | 148/6.2 |
| 3,053,692 | 9/1962 | Pocock | 148/6.2 |
| 3,431,136 | 3/1969 | Stilmar | 117/132 CF |
| 3,655,426 | 4/1972 | Fuchs | 428/421 |

*Primary Examiner*—Ralph S. Kendall
*Assistant Examiner*—Charles R. Wolfe, Jr.
*Attorney, Agent, or Firm*—Joseph P. House, Jr.

[57] ABSTRACT

A method for applying a coating on metal articles that is resistant to chemical and mechanical attack including the steps of first applying a galvanic zinc coating over a metal article, next applying a chromate coating over the zinc coating, drying the chromate coating, and thereafter applying a fluoroplastic resinous coating over the chromate coating.

8 Claims, No Drawings

METHOD OF APPLYING PROTECTIVE COATINGS TO METAL PRODUCTS

BACKGROUND OF THE INVENTION

1. Field.

This invention relates to improvements in the production of metal articles having a multiple-layer protective coating comprising successive layers of zinc, chromium and synthetic resin.

2. Description of the Prior Art.

During the past the requirements of the automobile industry regarding the corrosion resistance of the parts which are vital for the safety of the vehicle, as for instance brake conduits, have become more stringent and as a consequence correspondingly stricter regulations have been enacted regarding their quality that affect all production stages of such parts, thus giving rise to the problem of the present invention of providing a coating for corrosion protection which meets the requirements for the finished article and which is not only adequate to tolerate the mechanical deformation to which the corrosion protected article is subjected during manufacture and finishing operations, but which is also particularly suited to tolerate such treatment. Finally, it has to be kept in mind that the automotive industry has enormous quantity demands, as in the case of brake conduits for automobiles, so that a method had to be found which in practice has a very high production capacity.

A practical solution to the above problems is the method described in our co-pending U.S. patent application, Ser. No. 179,524, now U.S. Pat. No. 3808057, which generally employs the following sequence of steps:

a. Zinc plating is developed on a metal base body as a highly homogenous, fine crystalline structure. This may be accomplished by precipitation of the zinc plating in a sulfuric acid electrolyte at extremely high current densities of between 40 to 100 A/dm$^2$, the electrolyte temperature ranging between 50° and 55° C., and the electrolyte being vigorously agitated and including organic compounds.

b. A chromate plating on the zinc plated base body is produced in a chromic acid solution with a pH value of less than 2, and the chromated base body is rinsed in order to remove adhering residues of chromic acid solution.

c. The wet chromated base body is coated with a synthetic resin dispersion, and the coated base body is subjected to thermal treatment to convert the chromate coating to trivalent chromium and enable the synthetic resin to permeate the chromate coating.

The above is a summary of the method of our U.S. patent, and is qualified by reference to the patent itself. Our present invention contemplates still further improvements which are to be achieved by modification of certain features of the invention of our aforesaid U.S. patent.

SUMMARY OF THE INVENTION

Our present invention provides a method for applying a multiple-layer protective coating over a metal article including the steps of (1) galvanically coating the metal body with zinc having a finely crystalline, highly homogenous structure, (2) applying a chromate coating over the zinc coating by immersing the metal body in a chromic acid solution having a pH value higher than 2 and containing a reducing agent, (3) drying the chromate coating, (4) applying a plastic coating of fluoroplastic resins over the chromate coating, and then (5) subjecting the article to thermal treatment to jell the plastic coating without impairing the chromate coating.

The method of our present invention differs from that of aforesaid U.S. patent in that instead of a chromic acid solution with a pH value of less than 2, a chromic acid solution is used having a pH value higher than 2 and containing a reducing agent; in that the chromated base body, instead of being coated in a wet condition is plastic coated in a dry condition; in that a fluoroplastic resin dispersion is used; and in that the synthetic coating is dried in such manner that the water of crystallization within the chromate plating is not displaced.

More specific features of a method according to the present invention reside in the fact that the chromic acid solution has a pH value between 2.1 to 2.6; that formic acid is used as the reducing agent; that the chromate plating is temperature stabilized; that polyvinylfluoride is applied over the chromate coating; that the plastic coated base body is heated during the thermal treatment for a short time up to about 250° C.; and that after the thermal treatment the base body is chilled to about room temperature.

A further feature of the invention resides in the fact that the coated base body produced in accordance with the invention has a chromate plating thickness of from 5 to 10 microns.

An added advantage of this invention is that the equipment for carrying out the method, including the apparatus for the preparation of the surface to be zinc plated, for the zinc plating, for the chromating, for the plastic coating and for the thermal treatment, can be arranged in linear succession.

Our present method provides a multi-layer protective coating which satisfies the problems discussed above in that it is highly resistant to chemical attack and can also be mechanically deformed within wide limits during various manufacturing operations without harmful effects on the protective coating, all as will be more fully explained hereinafter.

DESCRIPTION OF THE PREFERRED EMBODIMENTS

The steps of the method of the present invention are set forth in the following parts (1) - (5) of this description in sufficient detail to instruct persons skilled in the art as to its practice, it being understood that the several embodiments and variations thereof are intended as illustrative and that it is expected that changes not specifically discussed may be made within the scope of the present invention.

The metal articles to be coated according to the present invention are usually steel articles or copper plated steel articles such as, for example, tubing to be used as brake lines for motor vehicles. The metal articles should be thoroughly cleaned before entering the coating process, such as by use of suitable electrolytic degreasing; preferably with a method which avoids excessive hydrogen diffusion into the article, and decapping operations as are typically used in the art of zinc plating and having due regard to the particular metal article to be coated.

1. Zinc coating.

The first step in the coating process of this invention is to galvanically apply a finely crystalline, highly homogenous zinc coating over the metal article. This is accomplished in a manner similar to the process described in our aforesaid U.S. patent by introducing the metal article into a zinc plating bath using a sulfuric acid electrolyte, at extremely high current densities of 40 to 100 A/dm², with the electrolyte being at a temperature of 50° – 55° C. and under vigorous agitation, and containing an organic compound which causes a fine crystalline structure of the zinc precipitate.

The sulfuric acid zinc plating may take place in three successively arranged zinc baths which have the same chemical composition but are separated from each other in order to provide a possibility to distribute the active high current density over several current rollers. Sulfuric acid zinc baths are prepared because these have an advantage over chloride and fluoro borate acid electrolytes in that they can be handled more easily within the bath passages. The sulfuric acid electrolyte is, moreover, not nearly as aggressive. Another advantage is that the precipitates from these baths are more resistant.

The corrosion behavior of the zinc platings as such becomes problematic if high current densities are employed. Generally, corrosion protection which is still acceptable may be obtained at current densities around 40 A/dm², but if current densities are employed which range around 70 – 100 A/dm², the crystalline structure becomes so coarse that it can no longer be considered as an homogenous precipitate. A coarsely crystalline zinc deposit would often include electrolyte remnants that would boil-off during thermal treatments and thereby pierce a plastic coating subsequently applied, and would also cause poor adhesion of a chromate coating applied over the zinc. This situation, which would deter the expert from introducing very high current densities, can be avoided by adding organic compounds to the bath such as, for instance, saccharin, thiorea, dimethylthiorea, polyethylene imine, polypropylene imine and others. These organic compounds, which function as fine grain builders and luster additives, insure the production of a finely crystalline structure of zinc plating in spite of the use of high current densities so that it is possible to operate at high production rates. The presence of an organic compound in the electrolyte causes to some extent their introduction into the zinc plating and there exhibits an inhibiting effect.

The high current densities, moreover, require a very vigorous agitation of the electrolyte. Naturally, an additional cathode movement is necessary which, however, is inherent in the continuous progression treatment as the articles move through successive baths. Vigorous agitation of the electrolyte is obtained by pumping it through pipes having evenly spaced holes located in the plating tanks. This kind of flow also supplies continuous fresh electrolyte and prevents impoverishment of the metal salts and additives therein. In continuously operating plants, permanent filtration of the electrolyte is necessary in order to insure uniform quality.

Examples of suitable zinc plating solutions may include the following components per liter of solution:

| | Bath 1 | Bath 2 |
|---|---|---|
| $ZnSO_4+H_2O$ (zinc sulfate and water of crystallization) | 850g. | 850g. |
| $Al_2(SO_4)_3+14H_2O$ (aluminum sulfate and water of crystallization) | 26g. | 26g. |
| $H_3BO_3$ (boric acid) | 6g. | 6g. |
| $ZnCl_2$ (zinc acid) | 4g. | 4g. |
| Saccharin | 0.25g. | 0.25g. |
| Thiocaramine | 0.25g. | 0.45g. |
| Polyethylene imine | — | 0.75g. |

2. Chromate coating.

The zinc plated articles are advanced into chromating equipment wherein a chromating coating is applied over the zinc coating. A chromic acid solution is used for this step which has a pH value of higher than 2, most usefully within the range of from 2.1 to 2.6. The chromic acid solution may contain sodium dichromate, sodium nitrate, nitric acid and concentrated acetic acid. Also, according to this invention, the chromic acid solution is to contain a reducing agent such as formic acid, formaldehyde or similar substances. With such a solution it is possible to obtain an unusually heavy layer thickness of from 5 - 10 microns during the short treatment period which is necessary for a continuously progressive method for coating articles.

The growth of the chromate coating should not be so rapid as to form a layer that becomes too spongy and has poor adhesion to the zinc layer. Inclusion of the reducing agent in the chromating solution results in the presence of a large amount of trivalent chromates and thereby provides a thermostable coating which can withstand the high temperatures of subsequent thermal treatment. The pH of the chromate solution should be closely controlled in order to determine when it must be refreshened so as to maintain the desired growth rate and thickness of the chromate layer.

Suitable chromate solutions may have the following composition (per 100 liters of solution):

a. 8–15 l of solution, containing 250–350 g/l sodium bichromate and 200–300 g/l sodium nitrate, which is standardized to a pH value of 0.3 by using nitric acid.

b. 3–8 l of solution, containing 500–700 g/l formic acid of 85% and c. 0.5–3 l glacial acetic acid by which the chromate solution is standardized to the appropriate pH value.

The balance of the solution is water.

3. Rinsing and drying the chromate coating.

The chromate coated article is rinsed with fresh water and then dried immediately after its formation to a spongy but rough condition. This produces an activating surface of the chromate coating that is particularly effective to produce intimate contact with the next layer of synthetic resin, and the dried chromate coating is hydrated and contains water of crystallization which is to be preserved therein upon application of the subsequent synthetic resin coating. The chromate coating is dried with hot air; it is made up largely of trivalent chromium and has an olive green color at this stage of the process. Care should be taken to insure drying is sufficient to prevent water or chromic acid solution remaining on the article in amounts that would deleteriously affect the plastic coating next applied.

4. Application of the plastic coating.

After the chromate coating is dried, a coating of synthetic resin is applied over the chromate coating. The synthetic material applied according to this invention consists of fluoroplastic materials by which term is meant, utilizing the ASTM definition, resins that are paraffinic hydrocarbons in which all or part of the hydrogen atoms have been replaced with fluorine atoms and which may also include chlorine atoms in their structure. The term "fluoroplastic" thus includes fluorocarbon resins such as polytetrafluorethylene (PTFE), fluorinated ethylene propylene (FEP), and polyhexafluoropropylene; flurohydrocarbon resins such as polyvinyl fluoride, polyvinylidene fluoride and polytrifluorostyrene; chlorofluorocarbon resins such as polychlorotrifluoroethylene (PCTFE); and chlorofluorohydrocarbon resins. These fluoroplastic substances have the advantage that a homogenous, closely pored surface forms even when the plastic film is very thin. Due to the property that these fluoroplastic substances absorb no water (they cannot be conditioned) the water of crystallinity remains within the chromate plating under the plastic coating. The fluoroplastic coating is applied as a dispersion, preferably in a high boiling solvent; a suitable example being a dispersion of polyvinylfluoride resin having 40% solids by weight with a gram size below 2 microns in a solvent mixture such as propylene carbonate (56%) and diethylene glycol (4%). The chromate coating should be thoroughly wetted with the fluoroplastics coating. The fluoroplastics coating should be applied evenly to the article, and suitable air nozzles may be employed to smooth out the coating.

5. Thermal Treatment.

The coated article is next subjected to thermal treatment to solidify the fluoroplastic coating and cause it to interlock with and adhere to the chromate coating, and at the same time preserve the water of crystallization in the chromate coating. The coated article is heated for a short time at a temperature of about 100° C. to 200° C., but most usefully at a temperature near 250° C., to evaporate the solvent and jell the fluoroplastic coating without impairing the chromate coating. The upper generally known temperature limit for the specific fluoroplastic used should be observed so as to prevent thermal decomposition of the material. The drying takes place in such a manner that the water of crystallization is not displaced from the chromate coating because without its presence, the chromate coating could separate from the previously zinc plated article in the form of a powder.

Thermal treatment is accomplished by passing the coated article through an oven, and the article is maintained therein for a short time to prevent sagging of the coating. Also, short drying time prevents loss of water of crystallization from the chromate layer. High circulation of hot air at a temperature of about 380° C. yields article surface temperatures of about 250° C. when the article is in the drying oven for 8 to 10 seconds and leads to rapid coagulation of the plastic coating. The actual time in the drying oven is increased by the time needed to heat the article, which varies with the running speed of the article and thickness of the plastic coating, being about 20 seconds for an article with a 14–18 micromillimeter thick plastic coating moving at 11m/min. After the thermal treatment, the coated articles are cooled rapidly to room temperature to consolidate the plastic coating with the chromate layer, cold water being suitable to achieve the desired rapid chilling. One or more additional plastic coatings can thereafter be applied if so desired.

High production rates are obtainable by a further development of the above method wherein the individual method steps are carried out sequentially in continuous progression. Thus, where tubing is to be coated, pieces of tubing can be connected together end to end and transported through the galvanizing plant, chromatizing zone, plastic coating and thermal treatment line. The continuous progression which represents a constant velocity of the base body during its movement through the individual method steps is significant because it affords an optimal manner of introducing the dried, just chromated body into the plastic dispersion and thereafter drying the chromating in such a manner that the water of crystallization therein is not displaced. The continuous mode of operation, moreover, insures a uniform quality at all times.

In order to check the corrosion protection of the finished product, a multiplicity of test procedures have been developed. Portions of these test procedures have been made delivery conditions or specifications in Germany, namely:

a. The condense water test (tropical test) according to DIN 50 017
b. Salt spray test (5% NaCl) according to ASTM-B117.

EXAMPLE

Steel tubing for brake conduits was coated according to the method of this invention as described above to form coated articles having a zinc plating thickness of 25 microns, a chromate plating thickness of from 6 – 8 microns and a plastic coating film thickness of 22 – 25 microns. The coated tubing was subjected to the above tests, and the results are set forth in line 2 of the following table. For comparison, line 1 shows the test results for corrosion protection of the same tubing with a zinc plating thickness of 25 microns (applied as described above) and a typical prior art blue chromate coating of 2 – 5 microns thick. It can be seen from the table, that the coated articles made according to this invention exhibit significantly greater corrosion resistance.

| No. | Shaping of the Test Specimens | Condense Water Test According to DIN 50 017 White Rust | Salt Spray Test According to ASTM-B117/64 White Rust | Red Rust |
|---|---|---|---|---|
| 1 | Sawed Straightened Bent | 1. Round (100%) | 24 hours (100%) | 240–312 hours |
| 2 | Sawed Straightened Bent | 261. Round (under 1%) | 2400 hours (10–30%) | 10,000 hours |

-continued

| No. | Shaping of the Test Specimens | Condense Water Test According to DIN 50 017 White Rust | Salt Spray Test According to ASTM-B117/64 White Rust | Red Rust |
|---|---|---|---|---|
| | Edged | | | |

Note:
In each instance 30 specimens were tested the results of which all fall within the indicated range.

In addition to the superior chemical resistance noted in the above example, coated metal articles according to this invention can withstand severe mechanical attack such as can occur when coated tubular articles are subjected to the severe mechanical operations involved in the manufacture of brake conduits. The tubing with a protective coating according to the invention is frequently bundled in partial lengths, temporarily stored and transported as necessary. Under these conditions, the elasticity of the plastic coating prevents damage to the contacting surfaces. In the production of brake conduits for automobiles, for instance, the tubing which is covered with a protective coating according to the invention passes through transfer conveyors with automatic distributing stations in some places, and bending apparatus and devices for flaring or edging the tubing ends to provide shoulders for tubing connectors and for accessories connection. The relatively small bending radii which are incurred during the bending may range in the order of three times the tubing diameter and are accepted by the tubing according to the invention without damage because the outer plastic coating provides an intermediate or slide layer for an applied bending tool and protects the metal surfaces from frictional damage. Lastly, the vigorous service conditions to which the finished product is exposed when installed on a vehicle are generally known, and articles produced under this invention can successfully withstand such exposed conditions.

The process as described above produces a coated metal article which has excellent chemical resistance and which can be physically deformed within wide limits without harmful effects upon the protective coating. This advantage is, among other reasons, due to the intimate bond between the chromate plating and the fluoroplastic coating which is achieved by the fact that the high activity of the chromic acid solution, assisted by the selected low pH value of the chromic acid solution, produces a chromate plating which immediately after its formation is spongy but rough when dry, with the result that this activated surface of the chromate plating in combination with the further method steps produces intimate contact with the plastic coating.

As a result of the subsequent coating of the chromated base body in a plastic dispersion, an optimal bonding of the plastic to the chromate plating takes place in two ways, namely, on one hand, in the form of an intimate interlock between the rough surface of the chromate plating and the plastic, and on the other hand, by the strong adhesion of the selected plastic to the chromate plating due to the preservation of the water crystallinity in the chromate plating. In the course of the subsequent thermal treatment this deep reaching interlock solidifies and produces a bonding layer.

The coated metal articles made according to the present method thus have a first layer of finely crystalline and highly homogenous zinc, which has a thickness of about 25 microns, that is the foundation layer of the system that serves as the last corrosion stop against chemical attack of the article. Over this is applied a second layer of the chromate coating which serves as an intermediate corrosion protection layer and also as a connecting layer between the zinc and the plastic coating; this layer is optimally about 5 to 10 microns thick. The last layer of the coated article is the fluoroplastic coating which is firmly bonded to the chromate layer as described above and provides excellent resistance against chemical attack, high temperature stability, and has good flexibility and antifriction properties useful to enable satisfactory processing of the coated article; this layer is optimally about 12 to 25 microns thick, although this can vary according to the user's requirements.

We claim:

1. In the method of providing a metal body with a protective coating that is resistant to chemical and mechanical attack and that comprises successive layers of zinc, chromate and synthetic resin applied to the metal body, in which the zinc is galvanically coated onto the metal body to have a finely crystalline, highly homogenous structure, the improvements comprising 1. applying a chromate layer over the zinc layer by immersing the metal body in a chromic acid solution having a pH value over 2 and containing a reducing agent to form a largely trivalent chromate layer;
2. rinsing and drying the chromate layer to form a layer containing water of crystallization;
3. applying a layer of fluoroplastic synthetic resin dispersed in a liquid over the dried chromate layer; and then
4. thermally treating the metal body to dry the fluoroplastic layer and cause it to interlock with and adhere to the chromate layer and remove said liquid therefrom while preserving water of crystallization in the chromate layer.

2. A method according to claim 1, wherein:
the chromic acid solution has a pH value of 2.1 to 2.6.

3. A method according to claim 1, wherein:
the reducing agent in the chromic acid solution is formic acid.

4. A method according to claim 2, wherein:
the reducing agent in the chromic acid solution is formic acid.

5. A method according to claim 1, wherein:
the fluoroplastic synthetic resin is polyvinylfluoride.

6. A method according to claim 1, wherein:
the thermal treatment takes place at about 250° C.

7. A method according to claim 1, wherein:
the fluoroplastic layer is chilled with water after the thermal treatment.

8. A method according to claim 1, wherein:
the zinc is coated onto the metal body at a thickness of about 25 microns,
the chromate layer is applied at a thickness of 5 – 10 microns, and
the fluoroplastic resin is applied at a thickness of 12 – 25 microns.

* * * * *